US007621088B2

(12) United States Patent
Simmons

(10) Patent No.: US 7,621,088 B2
(45) Date of Patent: Nov. 24, 2009

(54) SHEAR-WALL STRUCTURE AND METHOD EMPLOYING LATERALLY BOUNDING COLUMNS

(75) Inventor: Robert J. Simmons, Hayward, CA (US)

(73) Assignee: ConXTech, Inc., Hayward, CA (US)

( * ) Notice: Subject to any disclaimer, the term of this patent is extended or adjusted under 35 U.S.C. 154(b) by 754 days.

(21) Appl. No.: 11/203,610

(22) Filed: Aug. 12, 2005

(65) Prior Publication Data

US 2006/0059849 A1 Mar. 23, 2006

Related U.S. Application Data

(60) Provisional application No. 60/605,792, filed on Aug. 30, 2004.

(51) Int. Cl.
*E04C 2/284* (2006.01)
*E04C 2/28* (2006.01)

(52) U.S. Cl. ..... 52/309.7; 52/309.16; 52/309.17; 52/235; 52/601

(58) Field of Classification Search ..... 52/309.7, 52/309.16, 309.17, 601, 600, 235
See application file for complete search history.

(56) References Cited

U.S. PATENT DOCUMENTS

| | | | | | |
|---|---|---|---|---|---|
| 4,163,349 | A * | 8/1979 | Smith | 52/241 |
| 4,774,794 | A * | 10/1988 | Grieb | 52/309.7 |
| 4,813,193 | A * | 3/1989 | Altizer | 52/210 |
| 6,233,892 | B1 * | 5/2001 | Tylman | 52/309.12 |
| 6,408,594 | B1 * | 6/2002 | Porter | 52/794.1 |
| 6,779,314 | B1 * | 8/2004 | Fan | 52/309.12 |
| 6,857,237 | B1 * | 2/2005 | Dalphond et al. | 52/309.7 |

FOREIGN PATENT DOCUMENTS

| | | | |
|---|---|---|---|
| JP | 6-101295 | * | 4/1994 |
| JP | 6-146450 | * | 5/1994 |

* cited by examiner

*Primary Examiner*—Phi Dieu Tran A
(74) *Attorney, Agent, or Firm*—Jon M. Dickinson, PC; Robert D. Varitz, PC

(57) ABSTRACT

Building frame shear-wall structure and associated methodology wherein the resulting structure includes (a) plural, elongate, spaced, interconnected columns and beams including elongate stretches which define and perimeter nominally open panes, and (b) within each defined and perimetered pane, an introduced, cured body of curable structural flow material spanning and effectively forming a column-and-beam-anchored rigidifying shear panel in the pane.

11 Claims, 2 Drawing Sheets

SHEAR-WALL STRUCTURE AND METHOD EMPLOYING LATERALLY BOUNDING COLUMNS

CROSS REFERENCE TO RELATED APPLICATION

This application claims priority to prior filed, U.S. Provisional Patent Application Ser. No. 60/605,792 filed Aug. 30, 2004 for "Shear Wall Structure Employing Laterally Bounding Tubular Columns". The full disclosure content of that provisional application is hereby incorporated herein by reference.

BACKGROUND AND SUMMARY OF THE INVENTION

This invention relates to shear-wall building-frame structure, and in particular, to such structure which features spaced pairs of upright, elongate, next-adjacent columns that are load-bearingly interconnected with vertically spaced pairs of laterally spanning beams, and poured-in-place (typically concrete), generally planar, upright shear panels that carry shear loads into and between such columns and beams. Preferably, each such shear panel is formed in such a fashion that it embeds one or more lateral beam(s) which extend(s) between columns, and in the preferred embodiment of the invention which is disclosed and illustrated herein, such panels are illustrated in sizes including panels which embed but a single beam, and panels which embed a pair of such beams.

This invention also relates to methodology involved in the creation of shear-wall building-frame structure of the type just mentioned above.

As will become apparent, the structure of this invention offers special utility in plural-story, steel, column-and-beam-frame buildings.

While different specific materials may be employed to create the shear wall panels of the present invention, a preferred implementation of the invention is illustrated herein with such panels being formed of poured (or otherwise introduced) structural concrete of any appropriate, selectable constituent mixture.

The various features and advantages of this invention will become more fully apparent as the description which now follows is read in conjunction with the accompanying drawings.

DETAILED DESCRIPTION OF THE INVENTION

Figure 1:
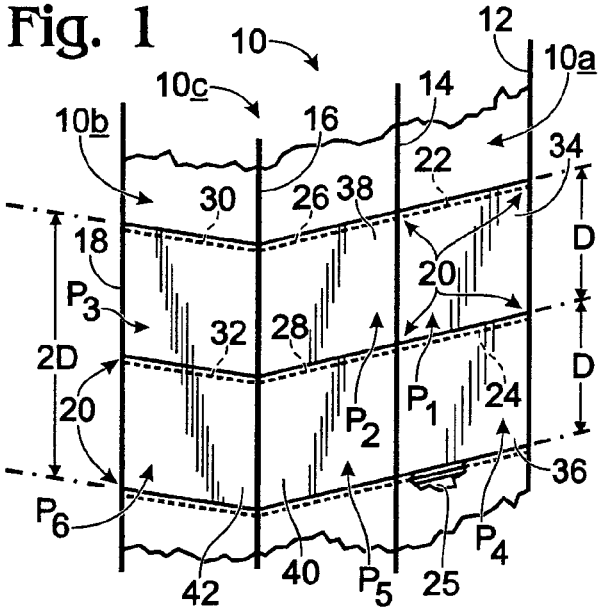
FIG. 1 is a fragmentary, simplified, schematic view of a plural-story, steel column and I-beam building-frame structure incorporating shear-wall structure constructed in accordance with a preferred and best mode embodiment of the present invention.

Turning attention now to the drawings, and referring first of all to FIG. 1, indicated generally and fragmentarily at 10 is a portion of a plural-story column-and-beam steel building-frame structure which embodies and utilizes shear-wall structure made in accordance with the structure and the practice of the present invention. Structure 10 is also referred to herein as shear-wall building-frame structure. In particular, what is shown in FIG. 1 is a portion of the mentioned building-frame structure which includes upright, orthogonally intersecting sides 10*a*, 10*b* which intersect at an upright, right-angle corner generally shown at 10*c*. Four upright, steel columns 12, 14, 16, 18, which are illustrated herein as being tubular in nature (though this is not required) are shown in FIG. 1, with columns 12, 14, 16 lying in frame side 10*a*, columns 16 and 18 lying in frame side 10*b*, and column 16 defining previously mentioned frame corner 10*c*. Pairs of columns 12, 14, columns 14, 16, and columns 16, 18, are referred to herein as next-adjacent, laterally-spaced columns in a pair of columns. As can be seen more clearly in FIGS. 3 and 4 in the drawings to which attention is now momentarily deflected, the columns, such as columns 12, 14 in frame 10, have generally square cross sections.

Extending between and interconnecting next-adjacent columns, through appropriate nodal connections (nodal points of intersection) which are shown generally at 20, are vertically spaced, horizontally extending I-beams, such as the several I-beams shown generally in FIG. 1 (by dashed lines) at 22, 24, 26, 28, 30, 32, and by solid lines at 25. Pairs of beams 22, 24, beams 26, 28 and beams 30, 32 are referred to herein as being pairs of vertically next-adjacent, elongate beams, or elongate beam stretches. The elongate regions of the columns which extend between connections 20 are referred to herein as column stretches.

As is traditionally the case, the vertical spacing between pairs of vertically next-adjacent beams, shown generally at D, defines a floor, or story, height in structure 10.

As can be seen clearly in FIG. 1, the elongate stretches of columns and beams which intersect at nodal connections 20 form rectangles in structure 10. These stretches are referred to herein as furnishing perimeter bounding, or boundaries, for a plurality of nominally open rectangular panes in frame 10, with six of these panes being shown specifically in FIG. 1 at $P_1$, $P_2$, $P_3$ $P_4$, $P_5$ and $P_6$. As will now be explained, it is within and spanning these panes that, in cooperation with the bounding column and beam stretches which define the panes, poured-in-place (or otherwise introduced), substantially planar, shear-wall panels are formed and implemented in accordance with the present invention. In FIG. 1, the bodies of five such poured-in-place panels are shown specifically at 34, 36, 38, 40, 42. In any suitable manner, and utilizing the bounding column and beam stretches as edge forms, and with appropriate opposite spaced facial forms put into place, structural flow material, such as structural concrete of a selectively suitable composition, is poured in place to form the various panes, with, as will now be more fully described, each pane capturing and embedding at least one laterally extending beam, or beam stretch. In general terms, panel 34 spans pane $P_1$ and captures the elongate stretch of overhead beam 22; panel 36 spans pane $P_4$ which is disposed immediately below pane $P_1$ and embeds the elongate stretch of overhead beam 24; panel 38 spans pane $P_2$ and embeds the elongate stretch of overhead beam 26; panel 40 spans pane $P_5$ and embeds the elongate stretch of overhead beam 28; and panel 42, which is a larger panel than those just previously mentioned, spans vertically next adjacent panes $P_3$ and $P_6$ and embeds the associated elongate stretches of beams 30, 32.

From the discussion presented above, and particularly with reference to the parenthetical phrases which have been included in reference to the "pouring" of concrete, it should be understood that all references herein to the pouring of concrete are intended to be references to any appropriate manner of introducing wet concrete into the regions where panels are to be formed.

Panels 34, 36, 38, 40 are shear-wall panels prepared in accordance with the practice of the present invention, which panels are specifically associated with one pane each defined by perimeter bounding stretches of associated pairs of next-adjacent columns and beams. Panel 42 is a larger shear-wall panel which has been prepared to span a pair of vertically next-adjacent panes. These two differently sized shear-wall panels, as illustrated in FIG. 1, highlight a feature of the invention which recognizes that shear-wall structure, including poured-in-place, cured flow-material panels, and associated stretches of interconnected columns and beams, can be implemented in a building frame in different ways according to the invention.

Figure 3:
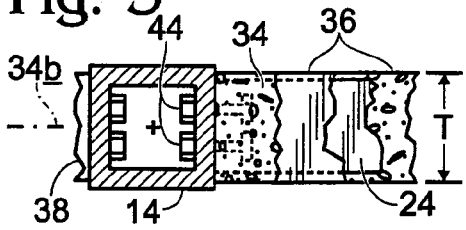
FIGS. 3 and 4 are further enlarged, fragmentary, cross-sectional views taken generally along the lines 3-3 and 4-4, respectively, in FIG. 2.
Figure 4:
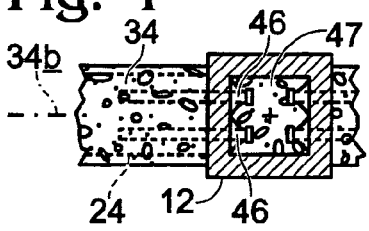
Figure 2:
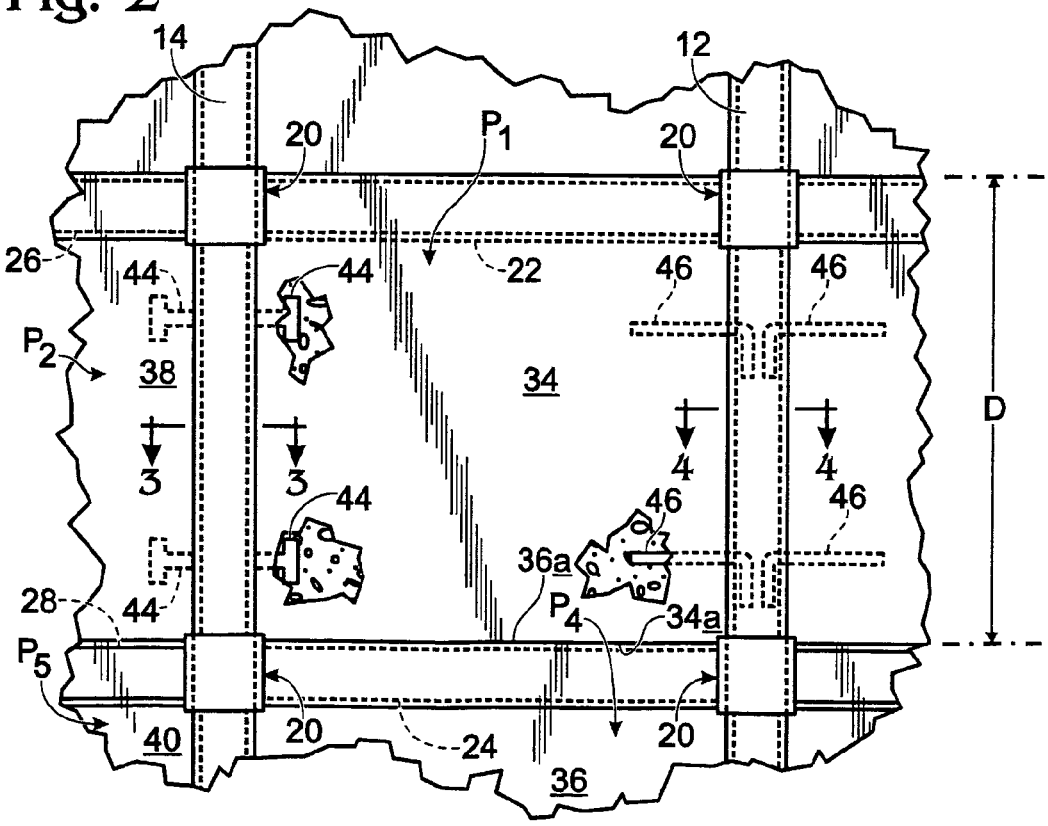
FIG. 2 is an enlarged, fragmentary, and somewhat more detailed view illustrating details of the shear-wall structure of this invention employed in the building-frame structure shown in FIG. 1.

With attention now directed to FIGS. 2-4, inclusive, along with FIG. 1, the column/beam/pane and poured-in-place panel structure so far described with respect to FIG. 1 is illustrated in somewhat greater detail in these three figures. Referring for a moment specifically to FIGS. 3 and 4, here it is clearly seen that the thicknesses T of the panels which have been mentioned so far, and these two figures specifically show panel 34 in pane $P_1$, are somewhat greater than the lateral width of the flanges in the I-beams, such as can be seen relative to I-beam 22, thus to highlight the fact that the poured-in-place panels fully encapsulate at least one transversely extending beam stretch. Specifically, and in the embodiment of the invention now being described, panels 34, 36, 38, 40 encapsulate the overhead beam stretches. These poured-in-place panels, in accordance with a preferred manner of implementing the invention, have their lower extremities lying substantially just above the upper levels of the beams disposed immediately below them, and residing in substantial contact with the top edge of the immediately underlying poured-in-place panel. This condition can clearly be seen in FIG. 2 where the lower extremity 34*a* of panel 34 resides just above the upper level of beam 24 and in substantial contact with the upper edge 36*a* of panel 36.

These substantially planar panels are disposed in structure 10 with their respective, nominal planes upright, and this can be seen especially well in FIGS. 3 and 4 where the nominal plane of panel 34 is shown at 34*b*.

Assisting in anchoring the poured-in-place panels to function as shear panels in the panes defined by the intersecting columns and beams, extending laterally into the panels from the adjacent sides of the bounding column stretches are elongate, projecting anchoring elements, such as the two different kinds of anchoring elements shown generally, respectively, at 44 and 46 in FIGS. 2, 3 and 4. Elements 44 are shown as taking the form generally of nut-and-bolt assemblies, and elements 46 are shown as taking the form of welded-in-place angular rebar-like components. These anchoring elements, also referred to herein as anchoring site structure, in any suitable form, thus become embedded with curing of the poured-in-place concrete flow material, to assist, as just mentioned above, in anchoring the shear-wall panels in the panes to function as shear load-bearing units with their immediately associated elongate column and beam stretches. Concrete, such as that shown at 47 in FIG. 4, may be introduced into the hollow interiors of the columns to aid in securing the anchoring elements.

It should be understood that any suitable form of anchoring element, intended to function like anchoring elements 44, 46, may be employed, and may be used in different patterns and numbers than what are illustrate herein in the drawings. Additionally, similar anchoring elements may be employed which extend into the poured-in-place panels from the associated beams.

Figure 5:
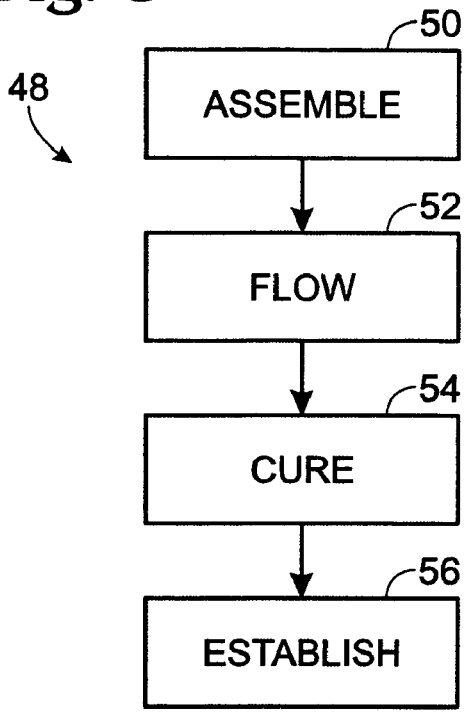
FIGS. 5, 6 and 7 are block/schematic diagrams illustrating the methodology of the invention.
Figure 6:
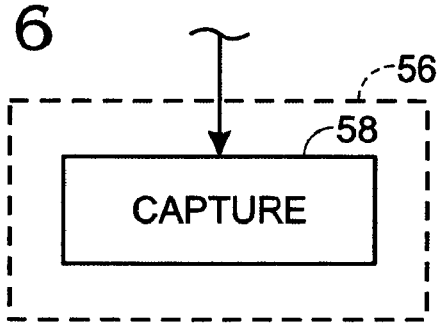
Figure 7:
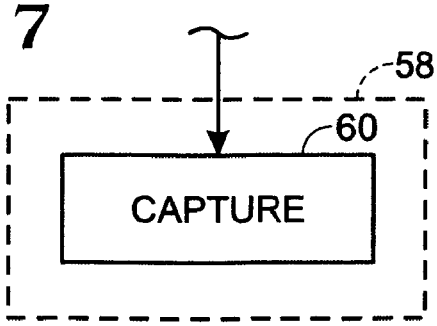

Addressing attention now to FIGS. 5-7 in the drawings, these three figures generally illustrate the methodology of the present invention. The overall architecture of this methodology is indicated generally at 48 in FIG. 5, and is represented by four blocks 50, 52, 54, 56 which are labeled, respectively, ASSEMBLE, FLOW, CURE, and ESTABLISH. This architecture/methodology can be described as taking the form of a method for creating building-frame shear-wall structure including the steps of: (a) assembling next-adjacent pairs of interconnected, elongate columns and beams to establish, through confronting, elongate, column and beam stretches, perimeter-bounded, nominally open, upright and substantially planar panes having thicknesses, measured normal to their respective planes, which are defined by the column and beam stretches which bound the respective panes (block 50); (b) for each such pane, and utilizing the stretches of columns and beams which perimeter-bound the pane as perimeter-defining, flow-material forms, flowing curable, structural flow material into the panes to produce a flow-material panel which substantially fully spans the pane, and possesses the mentioned, defined pane thickness (block 52); (c) curing the flowed material in each such panel to a condition of rigidity (block 54); and (d) during the curing process, establishing a condition of co-anchoring between the curing flow-material panel and the associated, bounding column and beam stretches (block 56).

Reference in this description of the overall methodology which is made to pane thicknesses essentially being defined by the column and beam stretches which are associated with the panes is intended to reflect what is shown in FIGS. 3 and 4 in the drawings with respect to the poured-in-place panels ultimately possessing a thickness T which is large enough to encapsulate the flange width of at least one beam stretch. One will note that in the embodiment and practice of the invention now being described, thickness T does not exceed the dimension of a column measured in the same "direction" as thickness T. In a modified practice of the invention, however, one could, of course, choose to cause lateral edges of a poured panel to embed, at least partially, an associated column stretch. In all situations, the ultimately chosen panel thickness T preferably is effectively defined by the associated column and beam stretches.

It will also be understood that, prior to the flowing of flow material taking place, suitable spaced facial forms made of any suitable planar material are provided on opposite sides of an open pane in order to provide lateral containment for poured-in-place flow material until that material cures.

FIG. 6 further illustrates the method step just described above which relates to block 56 in FIG. 5 by pointing out that the establishing procedure implemented by block 56 is conducted, at least in part, by causing the flowed flow material to embed at least a portion of one of the beam stretches associated with the relevant pane.

FIG. 7 in the drawings further details this just-mentioned "causing" step by pointing out that such causing is created by embedment capturing of a portion of at least one of the beam stretches associated with the relevant pane.

Accordingly, a novel shear-wall building-frame structure, and a methodology for implementing it, have been described and illustrated herein, wherein poured-in-place panels that completely span building-frame panes which are defined by pairs of spaced column and beam stretches become cured and solidified in place in such panes, thereafter to act as shear-wall structure integrated with columns and beams in a building frame.

It should be evident to those skilled in the art that the specific dimensions which one may choose to employ to implement this invention, and the specific kind of curable flow material which is chosen for use, are entirely matters of designer and user choice with respect to a particular building structure.

Accordingly, while a preferred and best mode embodiment of, and manner of practicing, the invention, and certain modifications, have been illustrated and described herein, it is appreciated that other variations and modifications may be made without departing from the spirit of the invention.

I claim:

1. Building frame shear-wall structure for use in a plural-story, site-built, building comprising plural, elongate, spaced, interconnected next-adjacent columns and next-adjacent beams including elongate stretches which define and perimeter nominally open panes, and within each said defined and perimetered pane, an introduced, cured body of curable structural shear-load-bearing flow material spanning and effectively forming a column-and-beam-anchored rigidifying shear panel in the pane, with each said shear panel being laterally bounded by a pair of next-adjacent columns.

2. The shear-wall structure of claim 1, wherein the material forming each panel in a pane embeds at least one of (a) a column stretch or a beam stretch which partially perimetrally bounds the pane, and (b) an element secured to such a column stretch or beam stretch and which extends laterally into the pane.

3. Building-frame shear-wall structure for use in a plural-story, site-built, building comprising plural, elongate, laterally spaced, generally upright columns, plural, elongate, vertically spaced, generally horizontal beams load-bearingly connected to said columns at spaced nodal points of intersection between the columns and the beams to form a structural building frame, with sets of next-adjacent, pairs of elongate stretches of the columns and beams defining and bounding plural, perimetered, generally planar panes, and disposed as a substantially planar, upright panel within and substantially fully spanning each said pane, cured, structural shear-load-bearing flow material which is anchored via an embedding condition to at least one column stretch and to at least one beam stretch which play roles in defining the pane, with each said panel being laterally bounded by a pair of next-adjacent columns.

4. The shear-wall structure of claim 3, wherein said flow material in each panel embeds said at least one beam stretch.

5. The shear-wall structure of claim 4, wherein each pane is bounded by upper and lower beam stretches, and said at least one beam stretch is the upper beam stretch.

6. The shear-wall structure of claim 3 which further includes, in each pane, elongate, anchoring-site structure joined to said at least one column stretch, and extending therefrom laterally and embeddedly into the flow-material panel in the pane.

7. A method for creating building-frame shear wall structure for use in a plural-story, site-built, building comprising assembling next-adjacent pairs of interconnected, elongate columns and beams to establish, through confronting, elongate, column and beam stretches, perimeter-bounded, nominally open, upright, and substantially planar panes having thicknesses measured, normal to their respective planes which are defined in relation to the column and beam stretches which bound the respective panes, for each such pane, and utilizing the stretches of columns and beams which perimeter-bound the pane as perimeter-defining, flow-material forms, flowing curable, structural flow shear-load-bearing material into the panes to produce a flow-material panel substantially fully spanning the pane and possessing the mentioned, defined pane thickness, with each said panel being laterally bounded by a pair of next-adjacent columns.

curing the flowed material in each such panel to a condition of rigidity, and during said curing, establishing a condition of co-anchoring between the curing flow-material panel and the associated, bounding column and beam stretches.

8. The method of claim 7, wherein said establishing is conducted, at least in part, by causing the flowed flow material to embed at least a length portion of at least one of the beam stretches associated with the relevant pane.

9. The method of claim 8, wherein said causing is created by embedment capturing of the mentioned portion of the at least one beam stretch associated with the relevant pane.

10. The method of claim 9, wherein each pane is associated with spaced upper and lower beam stretches, and the at least one beam stretch is the upper beam stretch.

11. The method of claim 7, wherein the mentioned condition of co-anchoring in a pane is produced, at least in part, by causing the flowed flow material to capture at least one elongate anchoring element which extends into the pane from one of the bounding column stretches.

* * * * *